US010535962B2

(12) United States Patent
So et al.

(10) Patent No.: US 10,535,962 B2
(45) Date of Patent: Jan. 14, 2020

(54) RECEPTACLE CONNECTOR

(71) Applicant: MPD Corp., Incheon (KR)

(72) Inventors: Hyun-Hwa So, Incheon (KR); Yong-Il Kim, Gyeonggi-do (KR)

(73) Assignee: MPD Corp., Incheon (KR)

( * ) Notice: Subject to any disclaimer, the term of this patent is extended or adjusted under 35 U.S.C. 154(b) by 0 days.

(21) Appl. No.: 16/003,829

(22) Filed: Jun. 8, 2018

(65) Prior Publication Data

US 2019/0334295 A1 Oct. 31, 2019

(30) Foreign Application Priority Data

Apr. 27, 2018 (KR) ..... 10-2018-0048864

(51) Int. Cl.
*H01R 9/05* (2006.01)
*H01R 24/38* (2011.01)
*H01R 13/64* (2006.01)

(52) U.S. Cl.
CPC ..... *H01R 24/38* (2013.01); *H01R 13/64* (2013.01)

(58) Field of Classification Search
CPC ..... H01R 24/38; H01R 13/64
USPC ..... 439/578, 675, 677
See application file for complete search history.

(56) References Cited

U.S. PATENT DOCUMENTS 5,704,809 A * 1/1998 Davis ..... H01R 13/434 439/349
7,025,630 B2 * 4/2006 Laverick ..... H01R 9/0518 439/578
7,347,727 B2 * 3/2008 Wlos ..... H01R 13/6277 439/578
7,922,528 B2 * 4/2011 Jackson ..... H01R 24/44 439/578
8,827,743 B1 * 9/2014 Maury ..... H01R 24/40 439/578

FOREIGN PATENT DOCUMENTS

| | | |
|---|---|---|
| JP | 2001-160465 | 6/2001 |
| JP | 2006-147493 | 6/2006 |
| KR | 1020180011659 | 2/2018 |

OTHER PUBLICATIONS

Office Action issued by the Korean Intellectual Property Office dated Aug. 24, 2018.
Notice of Allowance issued by the Korean Intellectual Property Office dated Nov. 13, 2018.

* cited by examiner

*Primary Examiner* — Khiem M Nguyen
(74) *Attorney, Agent, or Firm* — IP & T Group LLP

(57) ABSTRACT

A receptacle connector capable of preventing a damage caused by an insertion of a plug connector having a different standard. The receptacle connector may include: a receptacle shell; a contact pin coupling part into which a contact pin of a plug connector is inserted; and a plug shell coupling part providing an insertion space for a plug shell of the plug connector, between the receptacle shell and the contact pin coupling part. The plug shell coupling part may include: a fixed part fixed to the receptacle shell; and extension parts. A part of the extension parts may be first extension parts, the other part of the extension parts may be second extension parts, and distal end parts of the first and second extension parts may be extended on a plane perpendicular to the central axis of the fixed part, while being separated from each other.

11 Claims, 7 Drawing Sheets

RECEPTACLE CONNECTOR

CROSS-REFERENCE TO RELATED APPLICATION

This application claims priority under 35 U.S.C. § 119 to Korean Patent Application No. 10-2018-0048864 filed on Apr. 27, 2018, which is incorporated herein by reference in its entirety.

BACKGROUND

1. Field

Exemplary embodiments relate to a receptacle connector, and more particularly, to a receptacle connector capable of preventing a damage caused by an unintended insertion of a plug connector.

2. Discussion of the Related Art

A variety of signals are transmitted between wired/wireless communication devices, and communication devices to which signals are transmitted are electrically connected through a connector.

The connector couples target devices to transfer an electrical signal and ground voltage between the target devices. For example, the connector may be used to couple printed circuit boards to each other, couple a printed circuit board to a coaxial cable, or couple coaxial cables to each other.

Among the couplings, 'the coupling between the printed circuit boards' may be applied to efficiently use a limited space (for example, the inner space of a housing in a repeater). For example, a plurality of printed circuit boards stacked in a vertical or horizontal direction may be electrically coupled through the connector. Such a connector includes a pair of connectors composed of a plug connector and a receptacle connector. When the plug connector is inserted into the receptacle connector, the plug connector and the receptacle connector may be electrically coupled to each other.

The related art is disclosed in Korean Patent Publication No. 2018-0011659.

SUMMARY

Various embodiments are directed to a receptacle connector capable of preventing a damage caused by an insertion of a plug connector having a different standard.

In an embodiment, a receptacle connector may include: a receptacle shell; a contact pin coupling part into which a contact pin of a plug connector is inserted; and a plug shell coupling part providing an insertion space for a plug shell of the plug connector, between the receptacle shell and the contact pin coupling part. The plug shell coupling part may include: a fixed part fixed to the receptacle shell; and a plurality of extension parts extended from the fixed part. A part of the extension parts may be first extension parts, the other part of the extension parts may be second extension parts, and distal end parts of the first extension parts and distal end parts of the second extension parts may be extended on a plane perpendicular to the central axis of the fixed part, while being separated from each other.

In an embodiment, a receptacle connector may include: a receptacle shell; a contact pin coupling part into which a contact pin of a plug connector is inserted; and a plug shell coupling part providing an insertion space for a plug shell of the plug connector, between the receptacle shell and the contact pin coupling part, wherein the insertion space provided by the plug shell coupling part has at least two different widths at the same height.

DETAILED DESCRIPTION

Figure 1:
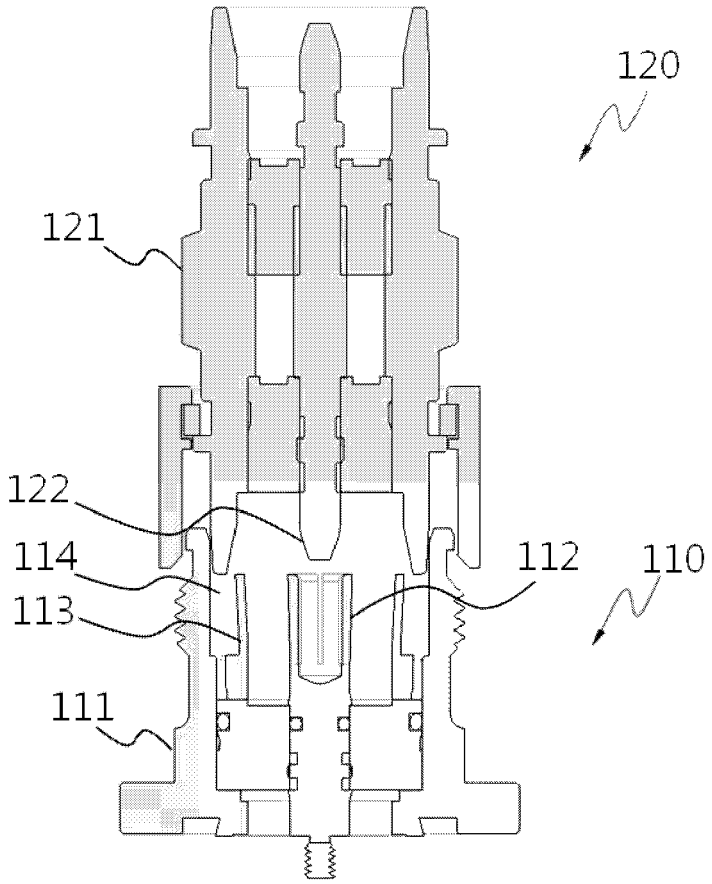
FIG. 1 illustrates a plug connector and a receptacle connector based on the same standard.

Since various modifications can be made while various embodiments can be provided, specific embodiments will be described with reference to the accompanying drawings. However, the present disclosure is not limited to the specific embodiments, but may include all modifications, equivalents and substitutes within the scope of the present disclosure. Throughout the disclosure, like reference numerals refer to like parts throughout the various figures and embodiments of the present invention.

Hereafter, exemplary embodiments will be described in detail with reference to the accompanying drawings.

Figure 2:
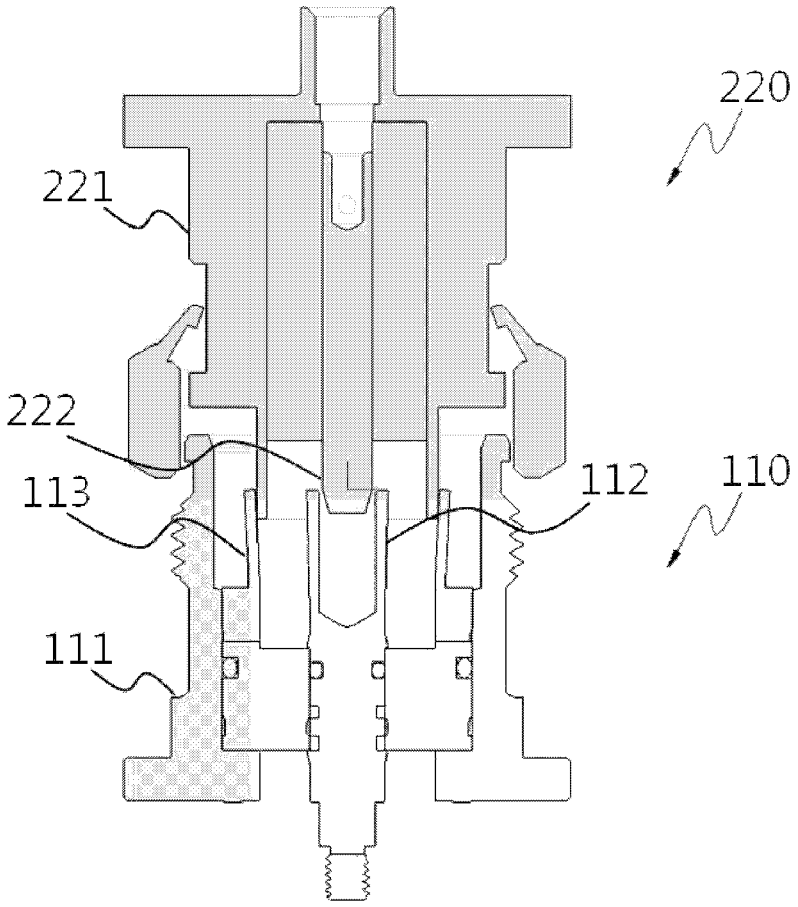
FIG. 2 illustrates a plug connector and a receptacle connector based on different standards.

FIG. 1 illustrates a plug connector and a receptacle connector based on the same standard, and FIG. 2 illustrates a plug connector and a receptacle connector based on different standards.

Referring to FIG. 1, a plug connector 120 may be inserted and fixed to a receptacle connector 110, and the plug connector 120 and the receptacle connector 110 may be electrically coupled to each other. The plug connector 120 may have a contact pin 122 connected to a contact pin coupling part 112 of the receptacle connector 110, in order to transfer a signal of a first substrate connected to the plug connector 120 to a second substrate connected to the receptacle connector 110.

Furthermore, the plug connector 120 may have a plug shell 121 inserted into an insertion space 114 which is provided by a plug shell coupling part 113. When the plug shell 121 is connected to a receptacle shell 111, the grounds of the first and second substrates may be electrically coupled to each other.

As such, the plug connector 120 and the receptacle connector 110 which have the same standard may be connected to each other so as to be reliably coupled to each other.

On the other hand, a plug connector 220 of FIG. 2 may have a structure based on a different standard from the plug connector 120 of FIG. 1. That is, the receptacle connectors 110 of FIGS. 1 and 2 may not have a structure for coupling to the plug connector 220 of FIG. 2, but basically have a structure for accommodating the contact pin and the plug shell. Thus, as illustrated in FIG. 2, the plug connector 220 may be inserted into the receptacle connector 110 having a different standard.

However, since the plug connector 220 of FIG. 2 includes a contact pin 222 having a larger diameter than the plug connector 120 of FIG. 1 and the plug shell 221 is inserted not between the plug shell coupling part 113 and the receptacle shell 111 but between the plug shell coupling part 113 and the contact pin coupling part 112, the receptacle connector 110 may be damaged by pressure applied to the contact pin coupling part 112 by the contact pin 222 and pressure applied to the plug shell coupling part 113 by the plug shell 221.

In order to solve the above-described problem, the present embodiment proposes a structure of a receptacle connector, which can prevent a damage of the receptacle connector even though plug connectors based on different standards are inserted into the receptacle connector.

Figure 3:
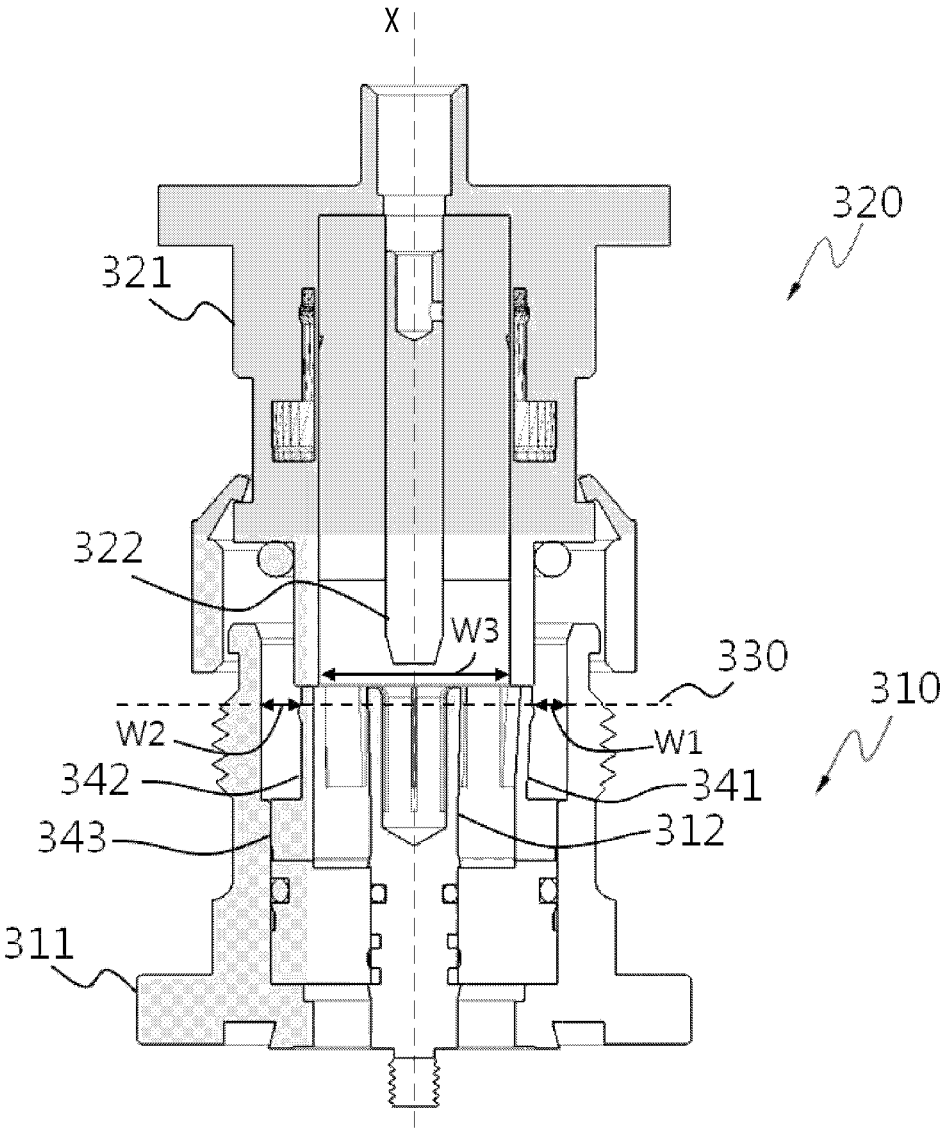
FIGS. 3 and 4 illustrate a receptacle connector in accordance with an embodiment.
Figure 4:
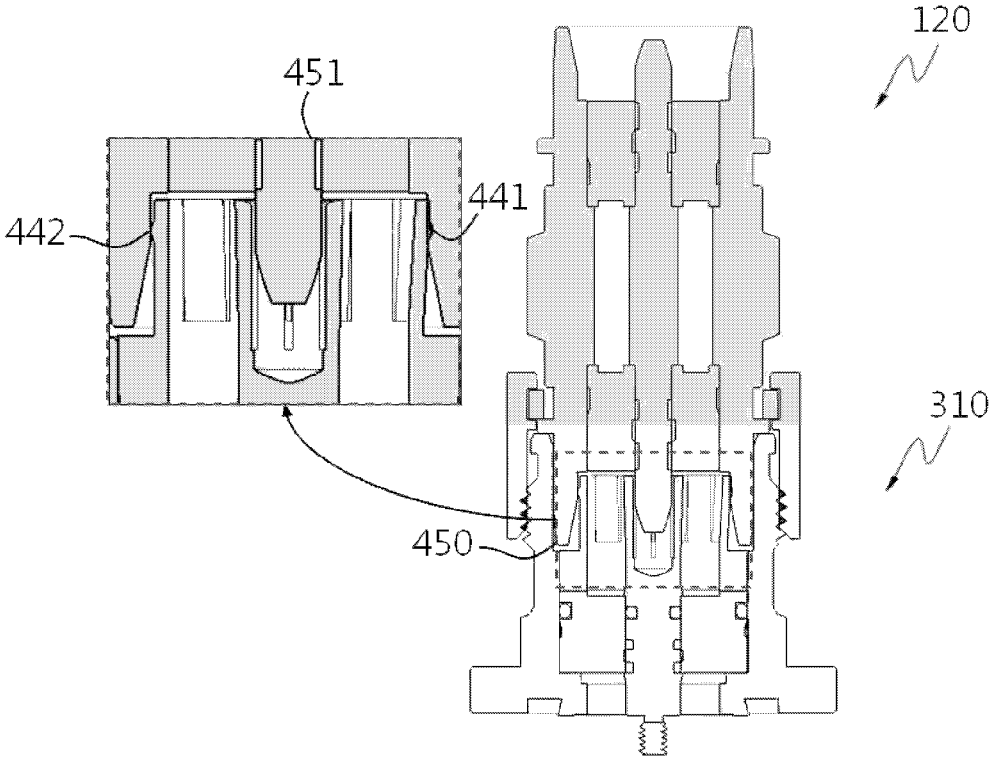
Figure 5A:
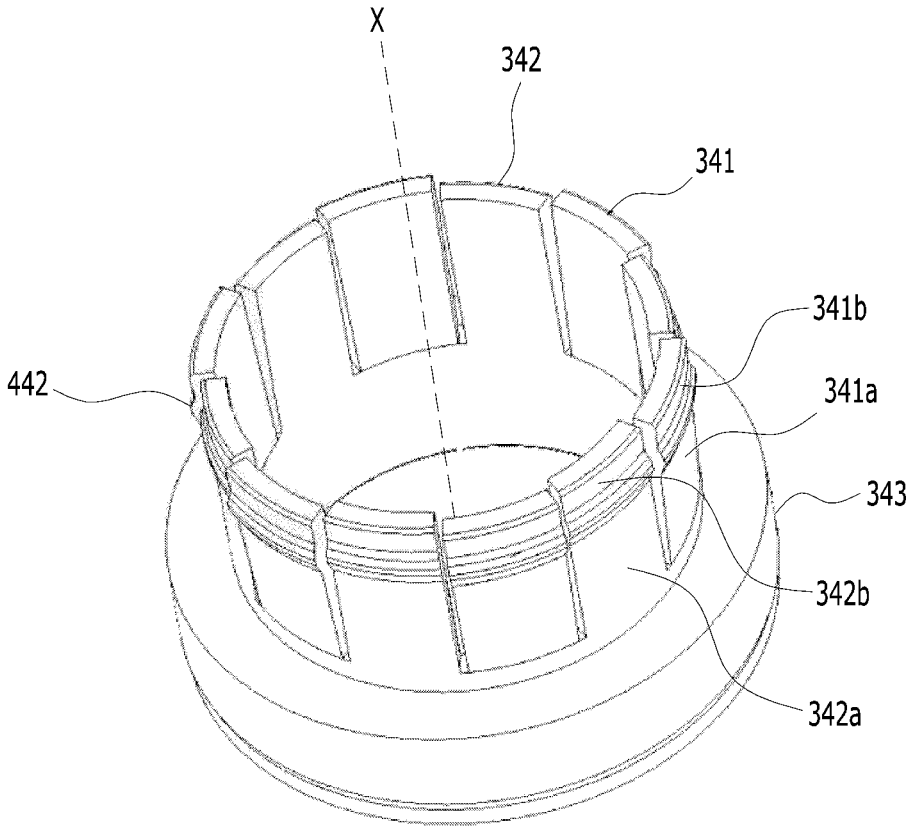
FIGS. 5A-5B illustrate a plug shell coupling part in accordance with the present embodiment.
Figure 5B:
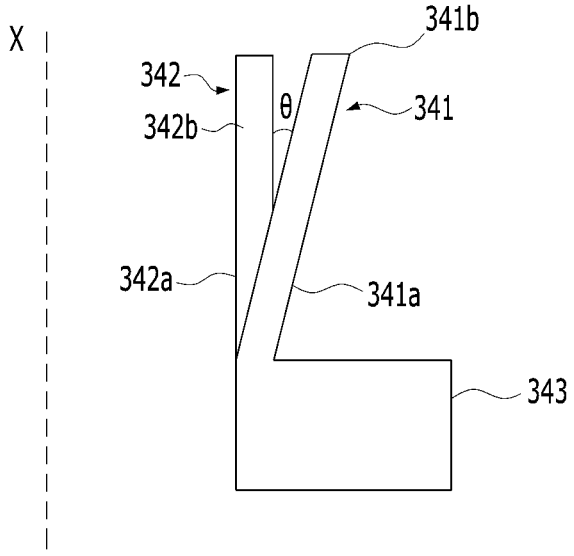

FIGS. 3 and 4 illustrate a receptacle connector in accordance with an embodiment, and are cross-sectional views of a plug connector and the receptacle connector. FIG. 5 is a perspective view of a plug shell coupling part in accordance with the present embodiment.

The plug connector 320 and the receptacle connector 310 in FIG. 3 may have different standards, and the plug connector 120 and the receptacle connector 310 in FIG. 4 may have the same standard. In FIG. 4, a red dotted line box 451 illustrates an expanded coupling relation 450 between the plug connector 120 and the receptacle connector 310.

Referring to FIGS. 3 to 5, the receptacle connector 310 in accordance with the present embodiment may include a receptacle shell 311, a contact pin coupling part 312 and a plug shell coupling part 340.

The contact pin of the plug connector may be inserted into the contact pin coupling part 312, and the plug shell coupling part 340 may provide an insertion space for a plug shell of the plug connector between the receptacle shell 311 and the contact pin coupling part 312. Such a structure may be applied for an insertion of the plug connector having the same standard as the receptacle connector 310.

At this time, the plug shell coupling part 340 may provide an insertion space having at least two different widths W1 and W2 at the same height 330, in order to prevent an insertion of a plug connector having a different standard from the receptacle connector 310. The plug shell coupling part 340 may include a fixed part 343 and a plurality of extension parts composed of first and second extension parts 341 and 342. For example, the first and second extension parts 341 and 342 may include first and second proximal end parts 341*a* and 342*a* and first and second distal end parts 341*b* and 342*b*, respectively. The first and second proximal end parts 341*a* and 342*a* may be positioned close to the fixed part 343, and the first and second distal end parts 341*b* and 342*b* may be positioned at the opposite side of the fixed part 343.

At this time, one or more first extension parts 341 and one or more second extension parts 342 may be alternately arranged as the plurality of extension parts. Alternatively, one first extension part 341 and one second extension part 342 may be alternately arranged as the plurality of extension parts.

The fixed part 343 may be fixed to the receptacle shell 311, and the first extension part 341 may be extended from the fixed part 343 in a first direction. The second extension part 342 may be extended from the fixed part 343 in a second direction different from the first direction. The first and second extension parts 341 and 342 may be isolated from each other, and alternately positioned.

For example, the plug shell coupling part 340 may include a plurality of extension parts extended from the fixed part 343. A part of the extension parts may be the first extension parts 341, and the other part of the extension parts may be the second extension parts 342. The distal end parts 341*b* of the first extension parts 341 and the distal end parts 342*b* of the second extension parts 342 may be extended on a plane perpendicular to the central axis X of the fixed part 343, while being separated from each other.

In an embodiment, FIGS. 3 and 5 illustrate that the distal end part 341*b* of the first extension part 341 is extended in a direction away from the contact pin coupling part 312, and the distal end part 342*b* of the second extension part 342 is extended in a direction parallel to the longitudinal direction of the contact pin coupling part 312. Between the first and second extension parts 341 and 342 and the receptacle shell 311, an insertion space may be provided. Since the first and second extension parts 341 and 342 are extended in different directions, the insertion space having two different widths W1 and W2 at the same height 330 may be provided between the first and second extension parts 341 and 342 and the receptacle shell 311. Since the first extension part 341 is extended in a direction away from the contact pin coupling part 312, the first width W1 may be smaller than the second width W2.

Therefore, an insertion of a plug connector having a different standard from the receptacle connector 310 may be blocked by the first or second extension part 341 or 342. In FIG. 2, since the plug shell coupling part 113 is extended only in a direction away from the contact pin coupling part 112, the plug shell 221 can be inserted into the receptacle shell. In accordance with the present embodiment, however, since the second extension part 342 is extended in parallel to the contact pin coupling part 112, an insertion of the plug shell 221 may be blocked by the second extension part 342.

On the other hand, the plug connector 120 having the same standard as the receptacle connector 310 may be inserted into the insertion space provided by the first and second extension parts 341 and 342 as illustrated in FIG. 4. Since the plug shell 121 of the plug connector 120 is not inserted between the contact pin coupling part 312 and the first and second extension parts 341 and 342 but inserted between the receptacle shell 311 and the first and second extension parts 341 and 342, the plug connector 120 may be inserted into the receptacle connector 310, even though the second extension part 342 is extended in parallel to the contact pin coupling part 112.

At this time, since the second width W2 by the second extension part 342 is larger than the first width W1, the plug shell 321 inserted into the insertion space formed by the second extension part 342 may not come in contact with the receptacle shell 311. In this case, the grounds of the first and second substrates may not be electrically coupled to each other. In order to solve such a problem, the second extension part 342 may include a protrusion part 442. The protrusion part 442 formed on the extension part 342 may come in contact with the inserted plug shell 321, and the plug shell 321 and the receptacle shell 311 may reliably come in contact with each other while the second width W2 is reduced by the protrusion part 442.

In another embodiment, the first extension part 341 may also have a protrusion part 441 which comes in contact with the inserted plug shell 321. The protrusion amount of the protrusion part may be decided depending on an extension direction of the extension part or an angle between the extension part and the fixed part.

In accordance with the present embodiment, the receptacle connector may employ a structure that accommodates a plug connector having the same standard and blocks an insertion of a plug connector having a different standard. Therefore, it is possible to prevent a damage of the receptacle connector, which may occur when a plug connector having a different standard is inserted.

Furthermore, the receptacle connector can solve a ground problem which may occur when the structure for preventing an insertion of a plug connector having a different standard is employed.

Referring back to FIG. 3, the plug connector 320 of FIG. 3 may have a different standard from the receptacle connector 310. FIG. 3 illustrates that an insertion of the plug shell 321 is blocked by both of the first and second extension parts 341 and 342. When the width W3 of the plug shell 321 is smaller than in the structure of FIG. 3, an insertion of the plug shell 321 may not be blocked by the first extension part 341, but blocked by the second extension part 342.

In an embodiment, the extension directions of the first and second extension parts 341 and 342 may be set to various directions, and decided according to a considered structure of the plug connector.

For example, the first extension part 341 may be extended in a direction away from the contact pin coupling part 312, and the second extension part 342 may be extended in a direction toward the contact pin coupling part 312. Alternatively, the first extension part 341 may be extended in a direction toward the contact pin coupling part 312, and the second extension part 342 may be extended in a direction parallel to the longitudinal direction of the contact pin coupling part 312. Alternatively, the first extension part 341 may be extended in a direction toward the contact pin coupling part 312, and the second extension part 342 may be extended in a direction away from the contact pin coupling part 312. Alternatively, the first extension part 341 may be extended in a direction parallel to the longitudinal direction of the contact pin coupling part 312, and the second extension part 342 may be extended in a direction away from the contact pin coupling part 312. Alternatively, the first extension part 341 may be extended in a direction parallel to the longitudinal direction of the contact pin coupling part 312, and the second extension part 342 may be extended in a direction toward the contact pin coupling part 312.

Alternatively, both of the first and second extension parts 341 and 342 may be extended in a direction toward or away from the contact pin coupling part 312. In this case, the first and second extension parts 341 and 342 may be extended from the fixed part 343 while being inclined at different angles.

Figure 6:
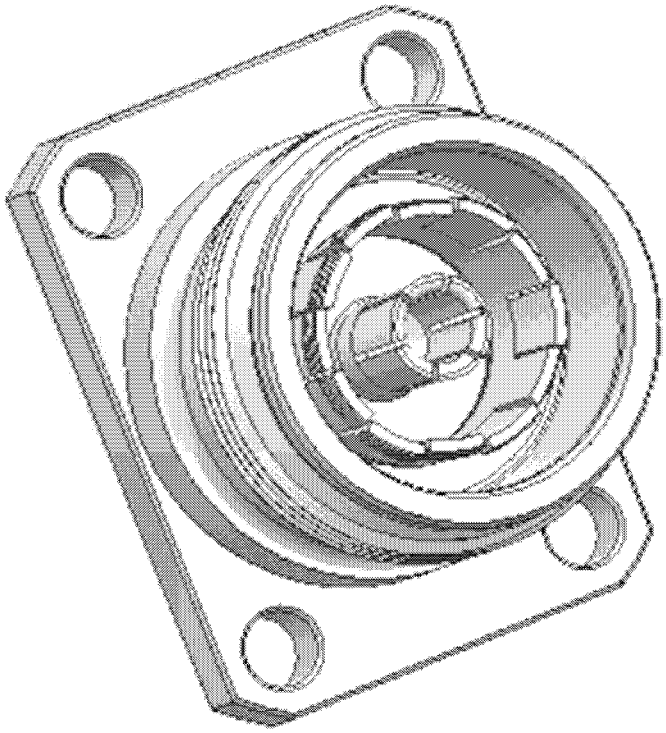
FIG. 6 is a perspective view of the receptacle connector in accordance with the present embodiment.
Figure 7:
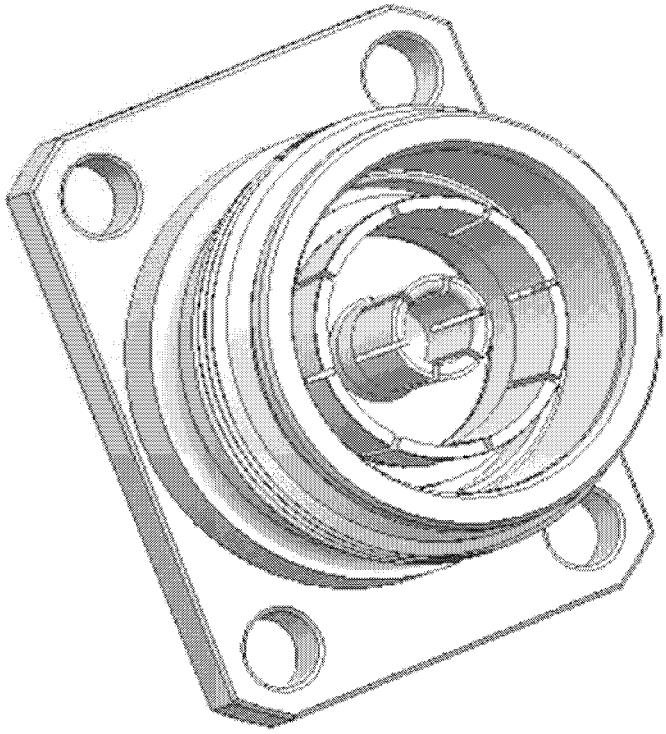
FIG. 7 is a perspective view of a general receptacle connector.

FIG. 6 is a perspective view of the receptacle connector in accordance with the present embodiment, and FIG. 7 is a perspective view of a general receptacle connector.

FIG. 7 illustrates that the extension parts of the plug shell coupling part are extended in the same direction, but FIG. 6 illustrates that the coupling parts of the plug shell coupling part are extended in two different directions.

In accordance with the present embodiment, the receptacle connector may employ a structure that accommodates a plug connector having the same standard but blocks an insertion of a plug connector having a different standard. Therefore, it is possible to prevent a damage of the receptacle connector, which may occur when a plug connector having a different standard is inserted.

Although various embodiments have been described for illustrative purposes, it will be apparent to those skilled in the art that various changes and modifications may be made without departing from the spirit and scope of the invention as defined in the following claims.

What is claimed is:

1. A receptacle connector comprising:

a receptacle shell;

a contact pin coupling part into which a contact pin of a plug connector is inserted; and a plug shell coupling part providing an insertion space for a plug shell of the plug connector, between the receptacle shell and the contact pin coupling part, wherein the plug shell coupling part comprises:

a fixed part fixed to the receptacle shell; and a plurality of extension parts extended from the fixed part, wherein a part of the extension parts is first extension parts, and the other part of the extension parts is second extension parts, and distal end parts of the first extension parts and distal end parts of the second extension parts are extended on a plane perpendicular to the central axis of the fixed part while being separated from each other.

2. The receptacle connector of claim 1, wherein the first extension parts and the second extension parts are alternately positioned.

3. The receptacle connector of claim 1, wherein at least one of the first and second extension parts comprises a protrusion part which comes in contact with the plug shell inserted into the insertion space.

4. The receptacle connector of claim 1, wherein the first extension part is extended in a direction away from the contact pin coupling part, and the second extension part is extended in a direction parallel to the longitudinal direction of the contact pin coupling part.

5. The receptacle connector of claim 1, wherein the first extension part is extended in a direction away from the contact pin coupling part, and the second extension part is extended in a direction toward the contact pin coupling part.

6. The receptacle connector of claim 1, wherein the first extension part is extended in a direction toward the contact pin coupling part, and the second extension part is extended in a direction parallel to the longitudinal direction of the contact pin coupling part.

7. The receptacle connector of claim 1, wherein the first extension part is extended in a direction toward the contact pin coupling part, and the second extension part is extended in a direction away from the contact pin coupling part.

8. The receptacle connector of claim 1, wherein the first extension part is extended in a direction parallel to the longitudinal direction of the contact pin coupling part, and the second extension part is extended in a direction away from the contact pin coupling part.

9. The receptacle connector of claim 1, wherein the first extension part is extended in a direction parallel to the longitudinal direction of the contact pin coupling part, and the second extension part is extended in a direction toward the contact pin coupling part.

10. The receptacle connector of claim 1, wherein the first and second extension parts are extended from the fixed part while being inclined at different angles.

11. A receptacle connector comprising:

a receptacle shell;

a contact pin coupling part into which a contact pin of a plug connector is inserted; and a plug shell coupling part providing an insertion space for a plug shell of the plug connector, between the receptacle shell and the contact pin coupling part, wherein the insertion space provided by the plug shell coupling part has at least two different widths at the same height, wherein the plug shell coupling part comprises: a fixed part fixed to the receptacle shell; a plurality of extension parts extended from the fixed part; and a protrusion part formed on at least one of the plurality of extension parts, and coming in contact with the plug shell inserted into the insertion space.

* * * * *